United States Patent [19]

Salam

[11] 4,323,889

[45] Apr. 6, 1982

[54] MATRIX DISPLAY DEVICES

[75] Inventor: Hassan P. A. Salam, London, England

[73] Assignee: Unisplay S.A., Geneva, Switzerland

[21] Appl. No.: 176,808

[22] Filed: Aug. 11, 1980

[30] Foreign Application Priority Data

Aug. 16, 1979 [GB] United Kingdom ..... 28559/79

[51] Int. Cl.[3] ..... G09F 11/00

[52] U.S. Cl. ..... 340/373; 40/446; 340/366 E

[58] Field of Search ..... 340/373, 366 E; 40/446, 40/449

[56] References Cited

U.S. PATENT DOCUMENTS 3,562,938 2/1971 Salam ..... 40/446

*Primary Examiner*—Harold I. Pitts

*Attorney, Agent, or Firm*—Laubscher, Philpitt & Laubscher

[57] ABSTRACT

An improved matrix display device is disclosed which includes a display matrix assembly having electromechanical display elements in horizontal rows and vertical columns. The assembly has two support portions extending the width of the assembly, one portion being at the top and the other being at the bottom. A rail member extends along the width of the matrix and is arranged to guide a movable electromagnetic head device. A series of hooks attach the rail member to one of the support portions at locations in the portion having a defined distance relative to each row of the matrix, thereby ensuring that the electromagnetic head device moves in registration with the rows of the matrix. A degree of resilience is included in the display device so as to apply tension between the support portions thereby maintaining the matrix assembly substantially flat. It is therefore unnecessary for the assembly to be made completely rigid, e.g. by including a sheet of glass, and the assembly may be left relatively flexible.

16 Claims, 12 Drawing Figures

MATRIX DISPLAY DEVICES

BACKGROUND OF THE INVENTION

1. Field of the Invention

This invention relates to improvements in matrix display devices of the high-density cellular type in which each element of a display is controlled by an individual cell enclosing a shutter electromagnetically movable between a position in which it opens and a position in which it closes an aperture through which, when open, light is visible to an observer. A device of this kind is described in U.S. Pat. No. 3,562,938.

2. Description of the Prior Art

Hitherto, cell matrices for display devices of the high-density cellular type have been constructed bonding together continuous plastics sheets, one of which is apertured to form the individual cells of the matrix, each of which cells may, for instance, contain a loose electro-magnetically movable shutter member. The matrix assembly has then been bonded to a sheet of glass to provide support and ensure flatness of the matrix. The glass sheet supporting the matrix has then been mounted in a cabinet frame which serves as a housing for the display. The floor of the cabinet frame includes a rail which guides a movable assembly of electromagnetic heads and determines its height relative to the cells of the display. It is necessary that each of the electromagnetic heads in the assembly shall follow a path in good alignment with an individual horizontal row of the matrix cells, in order to ensure correct operation of the display, since movement of each shutter between its open and closed positions is effected by appropriate selective energisation of the electromagnet appropriate to the cell rank containing that shutter, as the head assembly traverses the matrix.

The construction described above has disadvantages which it is the object of the present invention to overcome. These disadvantages are as follows:

(1) the display assembly is heavy and fragile because it includes a glass sheet;

(2) inaccuracy of registration between the individual heads and the respective rows of cells in the matrix may arise as a result of:

(a) the assembly of plastics sheets forming the matrix being itself not straight;

(b) the presence of manufacturing tolerances in the operation of bonding the matrix assembly to the glass sheet;

(c) the extruded member forming the rail which supports the head assembly may itself not be straight, but subject to initial manufacturing tolerances, and curvature of the rail may be opposite to that of the plastics matrix assembly.

SUMMARY OF THE INVENTION

The object of the invention is to overcome these difficulties and to provide a construction of matrix display device which enables very accurate registration to be obtained between the individual electromagnets in the movable head assembly and the respective row of cells in the matrix. Such accurate registration enables the number of cells per unit area in the matrix to be considerably increased, as compared with an arrangement with less accurate registration, since defective operation of the display device as a result of misalignment may be substantially wholly avoided.

In accordance with this object, the invention provides display apparatus including a display matrix assembly having display elements arranged in horizontal rows and vertical columns, a movable electromagnetic head device being arranged to move along the assembly so that individual electromagnetic heads in the head device activate display elements in the respective rows of the assembly, and guide means extending the width of the matrix assembly for guiding the electromagnetic head device during movement thereof. The guide means, preferably, a rail member, is attached to a support portion of the matrix assembly adjacent an edge thereof so as to maintain a defined distance between the guide means and the display elements of a row of the matrix assembly. Resilient means apply tension between the support portion of the assembly and another support portion adjacent the opposite edge of the assembly so as to maintain the matrix assembly substantially flat. This tensioning applied between opposite edges of the matrix assembly makes it unnecessary for the assembly to be completely rigid, for example by being bonded to a glass sheet as described above with reference to the prior art. The assembly may therefore be relatively flexible in directions between the support portions, the tension applied therebetween providing a substantially flat structure. The rail member is attached to the respective support portion preferably by means of a series of hooks engaging corresponding apertures in the support portion of the matrix assembly, and this attachment ensures registration between the rail member, and hence the head device guided by the rail member, and the matrix assembly. This improved registration enables the number of cells per unit area in the matrix assembly to be considerably increased compared with prior art arrangements.

BRIEF DESCRIPTION OF DRAWINGS

Preferred features and advantages of display devices embodying the invention will become apparent from the following description of different embodiments, given with reference to the accompanying drawings, in which.

DESCRIPTION OF THE PREFERRED EMBODIMENTS

Figure 1:
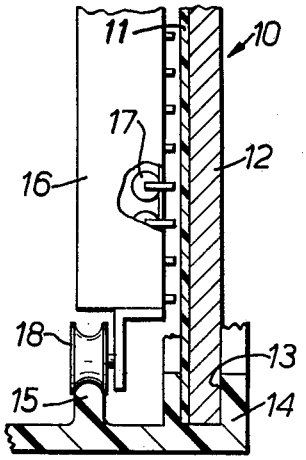
FIG. 1 is a partial cross-sectional view of a known construction of matrix display device of the general kind to which the present invention relates.

The known matrix display device 10 illustrated by FIG. 1 comprises a matrix assembly 11 consisting in known manner of a bonded-together assembly of three plastics sheets, the three sheets being continuous and the intermediate sheet being provided in known manner with a matrix of perforations, each of which forms a display cell of the kind described below with reference to FIG. 1A. These cells are arranged in horizontal ranks and vertical columns and each cell contains an electromagnetically movable shutter member. To maintain the matrix assembly in its aligned attitude, in the known device of FIG. 1 the array 11 is bonded to a glass sheet 12 which is mounted in a groove 13 provided in a cabinet frame formed by members such as member 14. Member 14 is provided with a rail portion 15 extending parallel to the groove 13. Rail portion 15 serves to support and guide an assembly 16 of electromagnetic heads 17, for which purpose the assembly 16 is provided with grooved wheels such as 18, that run on rail portion 15. Each of the electromagnetic heads 17 is intended to pass across the matrix 11 in alignment with a respective row of matrix cells, the nature of which will now be described with reference to FIG. 1A.

Figure 1A:
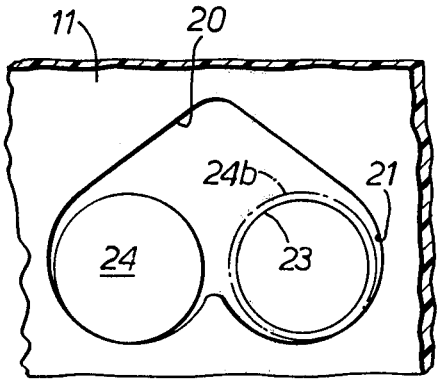
FIG. 1A is a view of one cell of a matrix array used in the device described with reference to FIG. 1; but drawn to a greatly enlarged scale.

FIG. 1A illustrates one display cell of the many that are arranged in matrix assembly 11. The assembly comprises three co-extensive sheets of plastics material, a rear sheet of transparent material, an intermediate sheet perforated to form the individual display cells, and a front sheet that is intrinsically opaque, or is coated so as to be opaque, save for an aperture aligned with each display cell as will be described. FIG. 1A shows a cell 20 of generally inverted cardioid shape. Aligned with one lobe 21 of the cell is an aperture 23 in the opaque front member of the assembly, and loose in the cell is an opaque, ferromagnetic shutter disc 24. Shutter disc 24 is movable in the cell between the position 24*a* in the left-hand cusp of the cell in which it is shown, when aperture 23 is unobstructed, and an alternative position 24*b* in which the shutter disc closes the aperture 23 and prevents the passage of light therethrough from a light source (not shown) contained within the cabinet formed by members 14.

As has already been mentioned, difficulties are found to arise in practice because of defective alignment between the electromagnetic heads 17 and the respective ranks of display cells such as 20.

Figure 2:
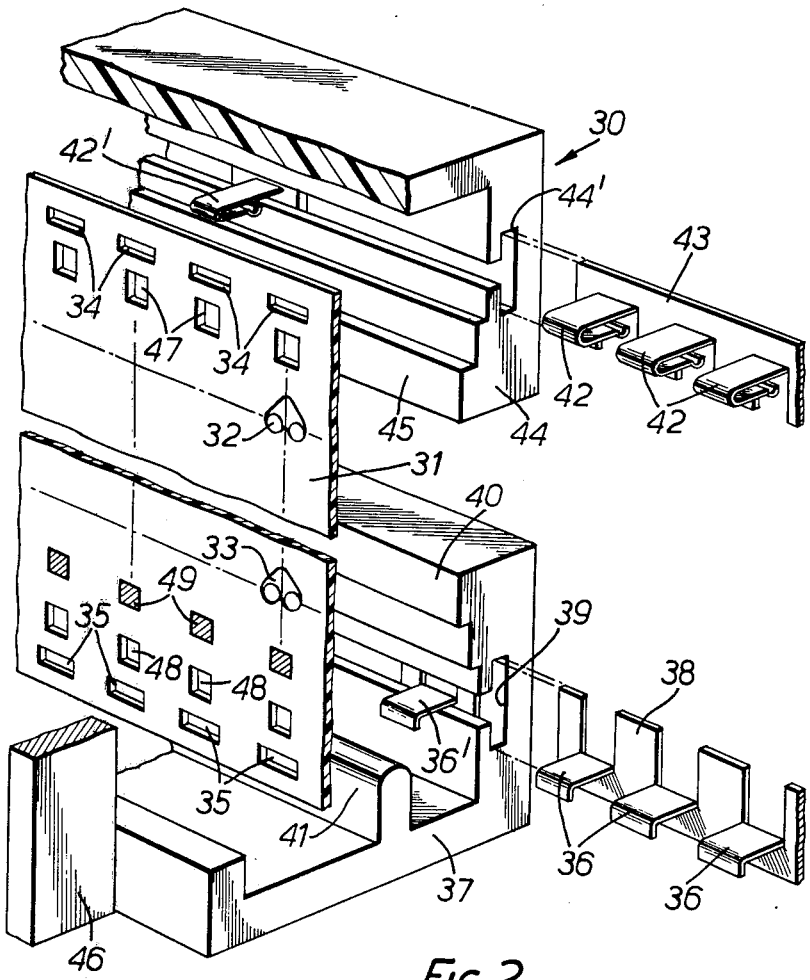
FIG. 2 is a partial perspective and exploded view of a display matrix and frame members, showing one preferred method of mounting the matrix assembly.

FIG. 2 illustrates a display device 30 according to one embodiment of the invention.

Figure 4:
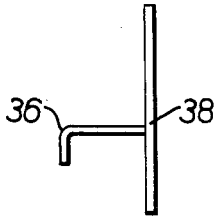

The display device 30 includes a matrix assembly 31 which includes horizontal rows and vertical columns, indicated by chain lines, of display cells 32, 33 of the kind described with reference to FIG. 1A, or otherwise constructed so as to be individually electromagnetically operable between the different display conditions. In the present embodiment, however, assembly 31 is not bonded to a glass sheet, but is mounted so as to be stretched into a generally flat form. To this end the upper and lower edges of matrix assembly 31 are provided with lines of equispaced slots 34, 35 that are engaged by mounting members secured to a cabinet frame as later described. The slots 35 of the row adjacent and parallel to the lower edge of the matrix assembly are engaged by rigid, hooked mounting members 36 that extend from a lower member 37 of the cabinet frame in which the display device is mounted. Advantageously and as shown, mounting members 36 are formed from a metal strip 38 that slides into a T-slot 39 in member 37. Each mounting hook 36 may be formed from an individual portion of metal strip, as is illustrated for hook 36' which is shown in place in slot 39, or several hooks may be formed from a single metal strip, as shown withdrawn from the slot 39. An end view of one such mounting member is shown in FIG. 4. It is preferred that such strips should not provide a large number of hooked mounting members 36, in order to avoid registration problems arising as a result of manufacturing tolerances. In this manner, the bottom marginal portion of matrix assembly 31 is held against a horizontal locating bar portion 40 provided on frame member 37. Parallel with locating bar portion 40, frame member 37 is provided with a rail portion 41, so that the described mounting arrangement ensures that the bottom edge of the matrix assembly 31 is always parallel to the guiding rail portion 41, even though frame member 37 may itself not be exactly straight.

Figure 3:
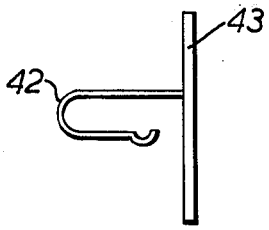
FIGS. 3 and 4 are end elevations of two mounting elements used in the construction illustrated by FIG. 2.

The slots 34 near the top edge of matrix assembly 31 are engaged by resilient supporting members 42 which hold the assembly taut in the vertical plane. Resilient mounting members 42 may be formed in sets from elongate single metal strips 43, as shown, or each mounting member may be formed from a single metal member as indicated at 42'. An end view of one such mounting member is shown in FIG. 3. The resilient mounting members are conveniently held in a T-slot 44' formed in a cabinet frame member 44, which may be identical in form with member 37, the form of the mounting members being such that matrix assembly 31 is held against a locating bar portion 45 of frame member 44.

Frame members 37 and 44 are held apart by a suitable plurality of vertically extending support members. The bottom end of one such support member is shown at 46, its upper end will be secured to upper frame member 44. Any suitable and convenient means of securing the support members to the cabinet frame members may be used.

In addition to mounting slots 34, 35, matrix assembly 31 may be provided with further rows of slots 47, 48, also disposed in lines parallel to the edges of the matrix assembly, which may be used to ensure registration of the moving head assembly with the vertical columns of display cells, in a manner later to be described. It may also be convenient to provide on the matrix assembly 31 a row of indexing markings 49, contrasting in reflectivity with the remainder of the matrix surface in this location, which may be used in conjunction with photoelectrically responsive means provided on the moving head assembly to ensure that the selective energisation of the electromagnetic heads is appropriately timed. It will be understood that the head assembly may be similar to the known arrangement described with reference to FIG. 1.

Figure 6:
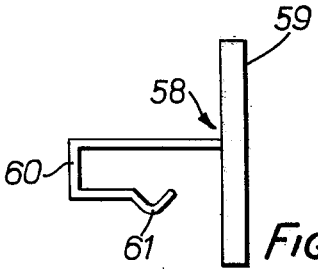
FIGS. 6 and 7 are end elevations of the mounting members used in the arrangement of FIG. 5.
Figure 5:
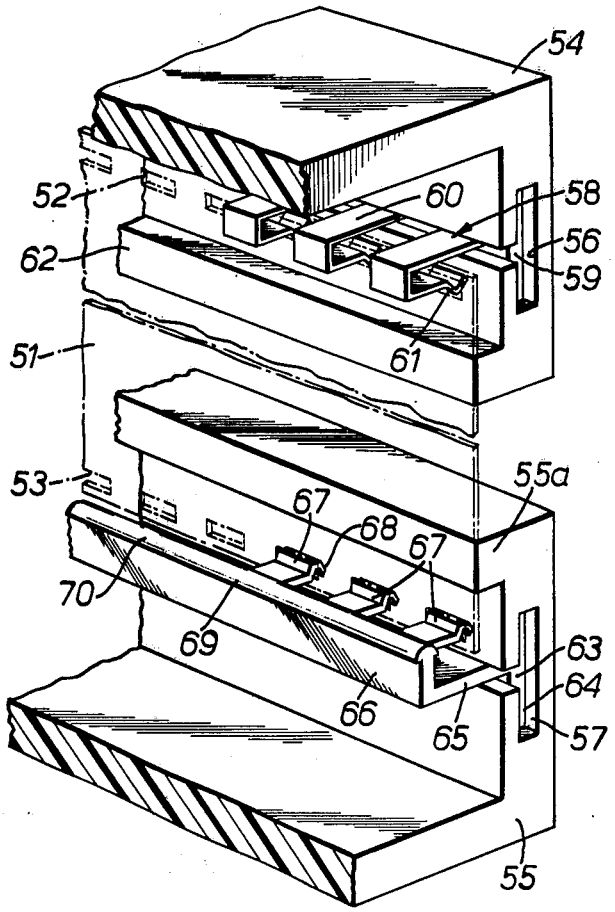
FIG. 5 is a partial perspective view showing an alternative mounting arrangement suitable for cooperation with a matrix assembly as described with reference to FIG. 2.

FIG. 5 shows an alternative manner of mounting a matrix assembly 51, shown in phantom outline, which is provided with lines of slots 52, 53 parallel to its upper and lower edges respectively, in the manner described with reference to matrix assembly 31 of FIG. 2. This matrix assembly is stretched between upper and lower cabinet frame members 54 and 55 which may be of similar configuration. Each frame member includes a respective T-slot 56, 57 in which are inserted respective sets of mounting members, which in this embodiment are formed of moulded plastics material. The upper mounting members 58 comprise a base portion 59, fitting within T-slot 56, from which extend resilient, reflexly bent and hooked arms 60, so formed that when the slots 52 in the matrix assembly 51 are engaged with hooked portions 61 of the resilient arms 60 the matrix assembly will abut against a locating bar portion 62 of frame member 54. FIG. 6 shows an end view of a mounting member 58.

Figure 7:
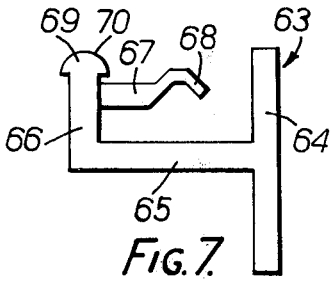

The slots 53 in the bottom edge of matrix assembly 51 are engaged with relatively rigid hooked mounting members forming part of a member 63 that also provides a guide rail for the movable electromagnetic head assembly used to actuate the display cell shutters. Member 63 comprises a base portion 64 which is arranged to fit within T-slot 57. A shelf portion 65 extends from base portion 64 through the open slot and supports a vertically extending rail portion 66, from which extend spaced-apart mounting members 67 having hooked ends 68 that engage in the slots 53 in matrix assembly 51. The upper end of rail portion 66 conveniently terminates in an overhanging semi-circular portion 69, upon which may be engaged by sliding a rail comprising a metal extrusion 70 of semicircular form with inturned lips. This arrangement is particularly convenient since it allows the lower edge of the matrix assembly to be held by a plurality of members 63, each provided with a relatively few mounting hooks, thus reducing any registration errors due to manufacturing tolerances, while providing an uninterrupted surface for the rail. An end view of a member 63 is shown in FIG. 7. The hooked portions 68 of mounting members 67 are so positioned that matrix assembly 51 abuts against a locating bar portion 55*a* of frame member 55.

Figure 8:
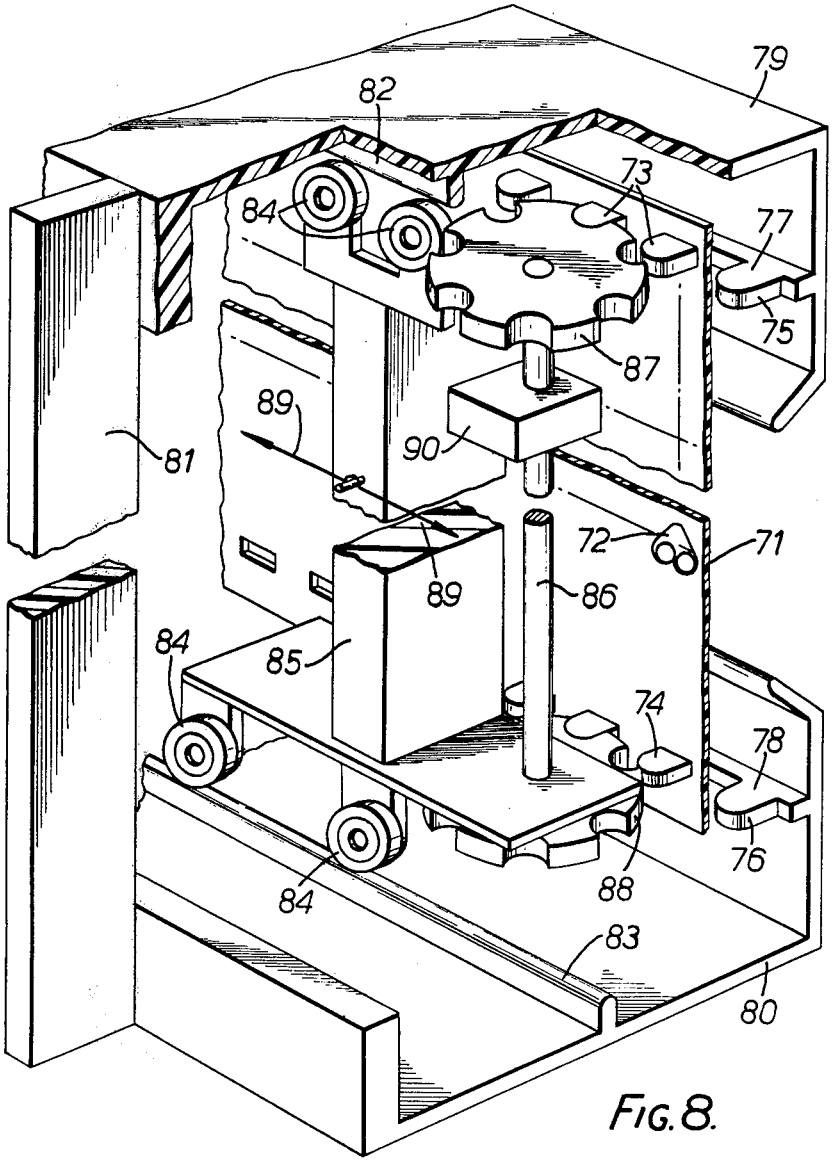
FIG. 8 is a partially sectional perspective view of portions of a display device, showing another preferred method of mounting the matrix assembly and an advantageous manner of ensuring vertical alignment of the movable head assembly.

FIG. 8 shows another construction of mounting for a display matrix which provides an additional advantage of facilitating the alignment of the travelling assembly of electromagnetic heads with the vertical columns of display cells in the matrix. The display matrix 71, comprising as before a multiplicity of display cells such as 72, arranged in horizontal ranks and vertical columns indicated by broken lines, is provided with sets of equispaced aligned slots 73, 74 adjacent respectively to its top and bottom edges. The sets of slots 73, 74 are advantageously arranged at a spacing integrally related to that of the columns of cells. These slots engage upon respective individual tooth portions 75, 76 extending from respective bar portions 77, 78 which are most conveniently formed integrally with respective upper and lower cabinet frame members 79, 80.

The pitch of the teeth 75,76 is advantageously made slightly greater than that of the slots 73, 74 formed in the matrix 71. This arrangement ensures that the matrix assembly is lightly tensioned in the horizontal direction as it is mounted on the teeth. Frame members 79, 80 are held apart, at a distance such as to subject the matrix assembly 71 to an appropriate vertical tension, by support members such as 81 secured by convenient and appropriate means to the frame members. At least a part of the top portion of member 79 is made of a flexible material so that it acts as a spring pulling the top of the matrix 71 upwards.

Each of frame members 79, 80—which are advantageously formed by extrusions of metal or of a strong plastics material, is provided with a rail portion 82, 83 respectively, which are parallel with the surfaces of bar portions 77, 78 against which matrix assembly 71 is located. Upon rail portions 82, 83 run wheels 84 that guide and support a travelling assembly 85 comprising a vertical array of electromagnetic heads (not individually shown). Each head in assembly 85 co-operates with a respective horizontal rank of display cells 72. In order to ensure that the vertical array of electromagnetic heads contained in assembly 85 shall always be correctly aligned with the columns of display cells 72, the travelling assembly 85 is provided with a rotatable vertical shaft 86 to which are fixed toothed wheels 87, 88 that engage with the portions of teeth 75, 76 that extend through matrix assembly 71. Assembly 85 is traversed in the horizontal direction with respect to matrix assembly 71 by means of appropriately moved cords or other flexible members, as indicated by arrows 89, coupled to a reversible driving motor, or alternatively a stepping motor 90 may be provided to rotate shaft 86 as required, or each of the toothed wheels 87, 88 may be driven by a respective stepping motor, in which case shaft 86 can be omitted. As the assembly moves, the synchronous rotation of wheels 87, 88 and their engagement with teeth 75, 76 ensures that assembly 85 always remains aligned with each column in turn of the display cells 72. The exact manner in which shaft 86 is mounted upon travelling assembly 85 is unimportant.

Figure 9:
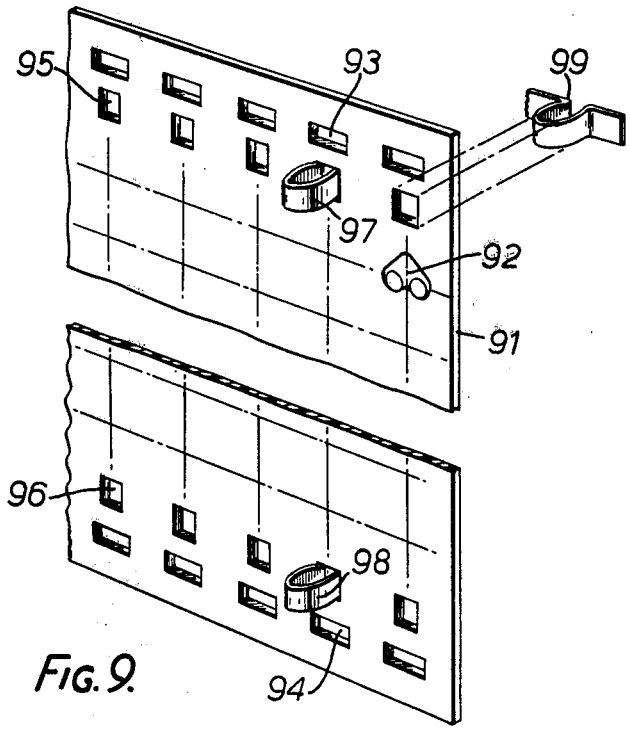
FIG. 9 shows a portion of a matrix assembly together with an alternative means for use in obtaining vertical alignment of the movable head assembly.

FIG. 9 illustrates a manner in which vertical alignment of a travelling assembly of electromagnetic heads may be achieved when a matrix assembly mounted as described in relation to FIG. 2 or FIG. 5 is employed. A matrix assembly 91, including horizontal ranks and vertical columns of display cells 92 is provided as before with aligned rows of slots 93, 94 extending adjacent its upper and lower edges respectively, which engage with mounting members (not shown) serving to locate and tension the display. There are also provided in the display, adjacent to slots 93, 94, further rows of apertures 95, 96 (corresponding to apertures 47, 48 of FIG. 2) the use of which is now described. In each of apertures 95, 96 there are inserted resilient members forming tooth-like projections such as are shown at 97, 98. The form of a resilient member suitable for this purpose is shown at 99. Such a member is conveniently formed from bent metal strip. The tooth-like projections 97, 98 are engaged by toothed wheels such as those described with reference to FIG. 8, fixed on a shaft carried by the travelling assembly of electromagnetic heads or otherwise arranged for synchronous rotation, and serving as above described to maintain alignment of the travelling heads with the columns of display cells.

Figure 10:
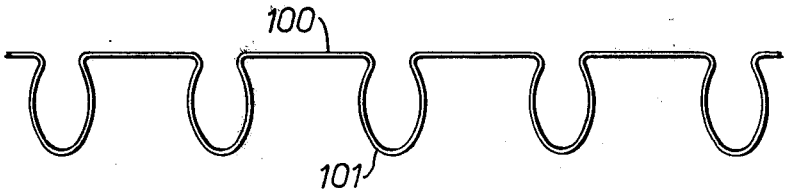
FIG. 10 illustrates an alternative form of member for use with the arrangement of FIG. 9, drawn to an enlarged scale.

FIG. 10 shows a convenient manner of providing the tooth-like members described in relation to FIG. 9. A strip of resilient metal 100 is bent to form a plurality of tooth-like projections 101, the form of the projections being such that they can, by resilient deformation, be engaged in apertures 95 or 96 of the display matrix assembly 91.

The construction described with reference to FIG. 9 may be modified: in that Figure it is indicated that one tooth-like projection 97 or 98 is provided in alignment with each column of display cells 92. This is not essential. The number of tooth-like projections does not require to be in a 1:1 relation with the number of columns of display cells; a larger number of projections is of some advantage in providing a smoother engagement of the tooth-like projections with the toothed wheels of the travelling head assembly. For example, three projections may be provided for every two columns of display cells, or even larger numbers if desired. Similar modifications may be made to the embodiment described in relation in FIG. 8 and to the embodiment now to be described with reference to FIG. 11.

Figure 11:
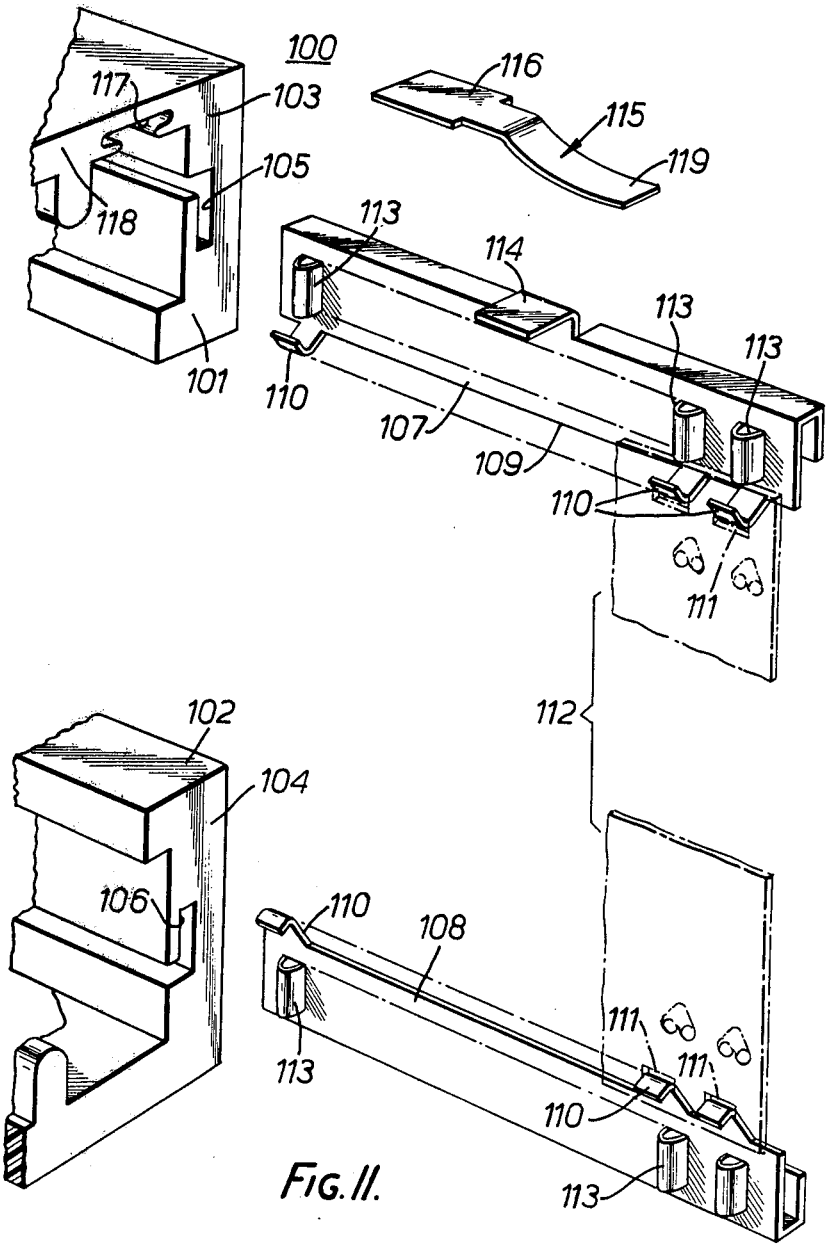
FIG. 11 is a partial perspective view of another arrangement for mounting a matrix.

In the arrangement 100 shown in FIG. 11, there are provided top and bottom frame members 101, 102. The vertical portion 103 of frame member 101 is provided with an inverted L-shaped channel 105, while vertical portion 104 of frame member 102 is provided with an L-shaped channel 106. In channel 103 of frame member 101 there is engaged a rigid member 107 of inverted J section. The lowermost edge 109 of that limb of member 107 which is disposed outside channel 105 is provided with hooked portions 110 that engage in slots 111 adjacent the top edge of a matrix assembly 12. Member 107 is also provided with sprocket teeth portions 113 (some only of which are shown) equally spaced along its length. Member 107 is also provided with at least one horizontally extending projection 114 which engages with a leaf spring member 115 having a wide base portion 116, that engages slidingly in a T-section slot 117 formed in a horizontal portion 118 of frame member 103, and having a narrower tongue portion 11 that passes beneath projection 114 of member 107 to exert an upward resilient force in that member.

A member 108, which may be identical with member 107 (though projection 114 is unnecessary), engages in channel 106 and likewise has hooked portions 110 to engage slots 111 in the bottom edge portion of matrix 112 and sprocket tooth portions 113.

This form of matrix mounting arrangement is suitable for cooperation with a travelling magnetic head assembly of the kind described with reference to FIG. 8.

The invention has been described with reference to one type of display element, but it is equally applicable to matrices using any other type of display element.

What is claimed is:

1. Display apparatus comprising:

a flexible display matrix assembly having a plurality of display elements arranged in horizontal and vertical rows, support portions of said assembly being disposed adjacent opposite edges thereof;

movable electromagnetic head means having electromagnetic heads for activating the display elements in respective rows of said matrix assembly;

guide means extending the length of one of said horizontal and vertical rows for guiding said electromagnetic head means during movement thereof;

means attaching said guide means to one of said support portions of the matrix assembly so as to maintain a defined distance between said guide means and the display elements of said one of said horizontal and vertical rows of said matrix assembly; and resilient means applying tension between said support portions so as to maintain said matrix assembly substantially flat.

2. Display apparatus as claimed in claim 1 wherein said support portions of said matrix assembly are disposed at the top and the bottom of said assembly.

3. Display apparatus as claimed in claim 1 wherein said guide means includes a rail member, said electromagnetic head means being arranged to engage and move along said rail member.

4. Display apparatus as claimed in claim 3 wherein said attaching means comprises hook means attaching said rail member to said one support portion at locations thereof so as to maintain the defined distance, said hook means engaging corresponding apertures in said one support portion.

5. Display apparatus including:

(a) a display matrix assembly having electromechanical display elements in horizontal rows and vertical columns, including first and second support portions each extending the width of said assembly, one portion being at the top and the other at the bottom of said assembly;

(b) rail means extending the width of the matrix assembly, guiding a movable assembly of electromagnetic heads;

(c) means hooking said rail means to the first of said support portions at locations in the portion having a defined distance relative to one of the rows of the matrix assembly; and (d) spring means pulling the second said portion away from the first in the vertical direction.

6. Display apparatus as claimed in claim 5 wherein the matrix assembly can be unhooked for replacement.

7. Display apparatus as claimed in claim 5 including first and second frame members for attachment to said matrix assembly at respectively said first and second support portions thereof.

8. Display apparatus as claimed in claim 7 wherein said rail means and said first frame member are formed as one continuous member.

9. Display apparatus as claimed in claim 8 wherein said first frame member is provided with a slot for receiving said hook means, said first support portion of the matrix assembly being provided with apertures corresponding to individual hooks of said hook means for engagement therewith.

10. Display apparatus as claimed in claim 7 wherein said rail means comprises a rail member located within a slot in said first frame member, said hook means comprising a plurality of hooks extending from said rail member and engaging corresponding apertures in said first support portion.

11. Display apparatus as claimed in claim 7 further including support members attached between said first and second frame members.

12. Display apparatus as claimed in claim 11 wherein said spring means comprises at least a portion of at least one of said frame members being resilient.

13. Display apparatus as claimed in claim 11 further including an intermediate member between one of said frame members and the respective support portion of the assembly, the intermediate member being coupled to said one frame member by said spring means which is located between said one frame member and said intermediate member so as to exert a resilient force on said intermediate member.

14. Display apparatus as claimed in claim 5 further including gear track elements protrude out of the plane of said matrix assembly, said electromagnetic head assembly having means for co-operating with said gear track elements so as to locate accurately said head assembly with respect to the columns of said display elements.

15. Display apparatus as claimed in claim 14 wherein said gear track elements comprise gear teeth arranged to project through openings in said matrix assembly, the pitch of the teeth being slightly greater than said openings, thereby tensioning the matrix assembly in the direction of the gear track elements.

16. Display apparatus including:

a display matrix assembly having electromechanical display elements in horizontal rows and vertical columns, including top and bottom support portions each extending the width of said assembly, said support portions comprising apertures provided in said assembly along the width thereof;

first and second frame members, at least said first frame member including a rail portion extending the width of the matrix assembly for guiding a movable electromagnetic head assembly, each of said frame members including a slot extending the width thereof;

first and second hook members arranged to be located in the respective slots of said first and second frame members, said hook members including a plurality of hooks projecting therefrom and engaging corresponding said apertures provided in said matrix assembly; and a spring member attached between one of said frame members and the respective hook member so as to exert a resilient force on said respective hook member thereby to tension the matrix assembly between said hook members.

* * * * *